US008442421B2

(12) United States Patent
Ichiki et al.

(10) Patent No.: US 8,442,421 B2
(45) Date of Patent: May 14, 2013

(54) CONVEYING PATH SWITCHING STRUCTURE AND IMAGE FORMING APPARATUS

(75) Inventors: Yukihiro Ichiki, Saitama (JP); Yasuki Tanaka, Saitama (JP); Satoshi Isahai, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 410 days.

(21) Appl. No.: 12/686,447

(22) Filed: Jan. 13, 2010

(65) Prior Publication Data

US 2010/0329761 A1 Dec. 30, 2010

(30) Foreign Application Priority Data

Jun. 29, 2009 (JP) ..... 2009-153170

(51) Int. Cl.
*G03G 15/00* (2006.01)

(52) U.S. Cl.
USPC ..... 399/401; 399/21

(58) Field of Classification Search ..... 399/401, 399/21, 18, 19; 271/65
See application file for complete search history.

(56) References Cited

U.S. PATENT DOCUMENTS

| | | | | |
|---|---|---|---|---|
| 5,680,651 | A * | 10/1997 | Tsuji et al. | 399/401 |
| 2005/0035540 | A1 * | 2/2005 | Carter et al. | 271/303 |
| 2006/0193666 | A1 * | 8/2006 | Tomatsu | 399/401 |
| 2007/0196127 | A1 | 8/2007 | Kubo et al. | |

FOREIGN PATENT DOCUMENTS

| | | | |
|---|---|---|---|
| JP | 2005-60058 | A | 3/2005 |
| JP | 2007-225799 | A | 9/2007 |
| JP | 2008-70522 | A | 3/2008 |

* cited by examiner

*Primary Examiner* — Judy Nguyen
*Assistant Examiner* — Blake A Tankersley
(74) *Attorney, Agent, or Firm* — Sughrue Mion, PLLC

(57) ABSTRACT

A conveying path switching structure includes a cover unit and a conveying path switch unit. The cover unit is attached to an image forming apparatus main body so as to be movable between a close state and an open state in which a fixing unit is exposed. The conveying path switch unit is rotatably attached to the cover unit and that switches a conveying path of a record medium between a discharge conveying path and a double-side conveying path. The discharge conveying path is a path where the record medium is conveyed from a discharge part of the fixing unit to a discharge unit that discharges the record medium to outside of the image forming apparatus main body in a close state. The double-side conveying path is a path where the record medium is conveyed again to an image forming unit.

9 Claims, 21 Drawing Sheets

CONVEYING PATH SWITCHING STRUCTURE AND IMAGE FORMING APPARATUS

CROSS-REFERENCE TO RELATED APPLICATIONS

This application is based upon and claims priority under 35 USC 119 from Japanese Patent Application No. 2009-153170, filed Jun. 29, 2009.

BACKGROUND

Technical Field

This invention relates to a conveying path switching structure and an image forming apparatus using the conveying path switching structure.

SUMMARY OF THE INVENTION

According to an aspect of the invention, a conveying path switching structure includes a cover unit and a conveying path switch unit. The cover unit is attached to an image forming apparatus main body so as to be movable between a close state and an open state in which a fixing unit is exposed. The conveying path switch unit is rotatably attached to the cover unit and that switches a conveying path of a record medium between a discharge conveying path and a double-side conveying path in the close state. The discharge conveying path is a path where the record medium is conveyed from a discharge part of the fixing unit to a discharge unit that discharges the record medium to outside of the image forming apparatus main body in a close state. The double-side conveying path is a path where the record medium is conveyed again to an image forming unit of the image forming apparatus main body from the discharge unit in a state where the record medium are inverted.

BRIEF DESCRIPTION OF THE DRAWINGS

Exemplary embodiments of the invention will be described in detail based on the following figures, wherein.

DETAILED DESCRIPTION

An exemplary embodiment of the invention will be discussed below with reference to the accompanying drawings.

Exemplary Embodiment 1

Figure 2:
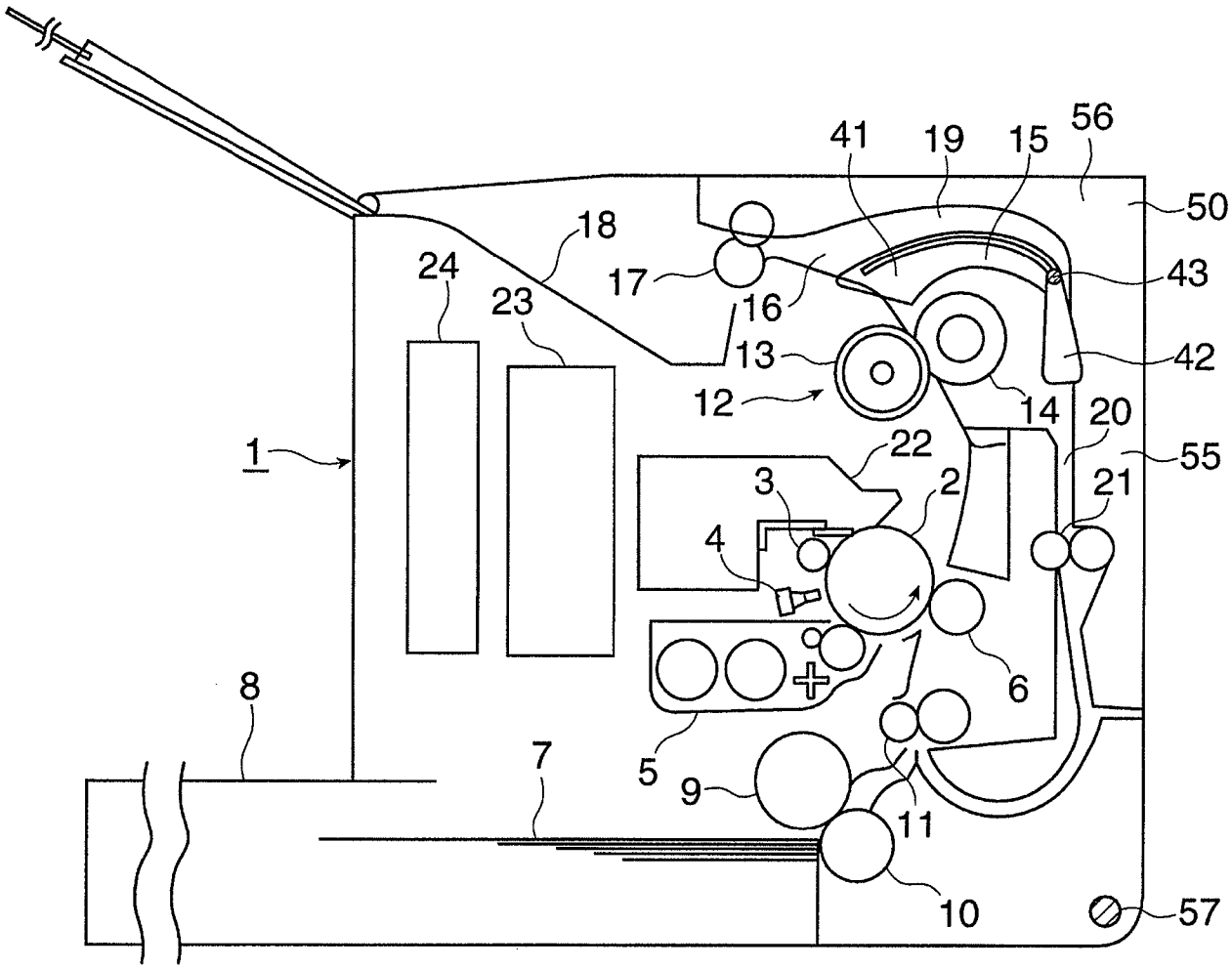
FIG. 2 is a configuration drawing to show the monochrome image forming apparatus as the image forming apparatus incorporating the conveying path switch unit according to Exemplary embodiment 1.

FIG. 2 is a schematic configuration drawing to show a monochrome image forming apparatus as an image forming apparatus incorporating a conveying path switching structure according to an Exemplary embodiment 1 of the invention.

In FIG. 2, numeral 1 denotes a main body of the image forming apparatus, and the image forming apparatus main body 1 is formed like a box of a rough rectangular parallelepiped. A photoconductive drum 2 as an image carrier is disposed to the right slightly at the rough center in the image forming apparatus main body 1 and is rotated at a predetermined speed along an arrow direction by drive means (not shown). A surface of the photoconductive drum 2 is charged to a predetermined potential by a charging roll 3 and the photoconductive drum 2 is subjected to image exposure responsive to image information by an LED exposure device 4 as image exposure means to form an electrostatic latent image. The electrostatic latent image formed on the surface of the photoconductive drum 2 is visualized by a developing device 5 to form a toner image, and the toner image is transferred onto a record sheet 7 as a record medium by a transfer roll 6 as transfer means. The photoconductive drum 2, the charging roll 3, the LED exposure device 4, the developing device 5, and the transfer roll 6 make up an image forming unit.

The record sheet 7 is fed from a sheet feed tray 8 as sheet feed means placed on a bottom of the image forming apparatus main body 1 in a state in which the sheets are separated one sheet at a time by a sheet feed roll 9 and a separation roll 10. The record sheet arrives at a registration roll 11 and is conveyed to a transfer position where the photoconductive drum 2 and the transfer roll 6 abut each other in a synchronized state with the toner image on the photoconductive drum 2 by the registration roll 11.

The record sheet 7 to which the toner image has been transferred from the photoconductive drum 2 as described above is conveyed to a fixing unit 12 as fixing means by a conveying force of the photoconductive drum 2 and the transfer roll 6 and is heated and pressed by a heating roller 13 and a pressing roller 14 of the fixing unit 12, and an unfixed toner image is fixed on the record sheet 7. The record sheet 7 with the toner image fixed thereon is conveyed to a discharge conveying path 16 through a switch gate 15 as a conveying path switch unit and is discharged onto a folding discharge tray 18 provided in an upper part of the image forming apparatus main body 1 by a discharge roll 17 as discharge unit provided in the discharge conveying path 16.

A discharge part of the fixing unit 12 is provided with the discharge conveying path 16 for conveying the record sheet from the discharge part of the fixing unit 12 to the discharge roll 17 and is also provided with the switch gate 15 for rotation on a support shaft 43. The position of center of gravity of the switch gate 15 is set so that the switch gate 15 stops at a first position closing the discharge conveying path 16 under the tare weight (rotation moment) of the switch gate 15 as shown in FIG. 2 in a usual state in which the record sheet 7 does not pass through.

The discharge roll 17 is configured so that the rotation direction can be switched between a forward direction for discharging the record sheet 7 onto the discharge tray 18 and an inversion direction for conveying the record sheet 7 in the opposite direction to the discharge direction.

Further, a double-side conveying path 19 is provided above the switch gate 15. The double-side conveying path 19 is placed in an open state by the switch gate 15 restored to the first position after the trailing end of the record sheet 7 conveyed from the discharge part of the fixing unit 12 to the discharge roll 17 and discharged onto the discharge tray 18 by the discharge roll 17 passes through the switch gate 15. The double-side conveying path 19 again conveys the record sheet 7 to the image forming unit at the double-side image forming time. The double-side conveying path 19 is formed so as to communicate with a double-side conveying path 20 extending downward along a side face of the image forming apparatus main body 1 after passing through above the switch gate 15. A conveying roll 21 for conveying the record sheet 7 to the registration roll 11 is provided in the double-side conveying path 20 extending downward.

At the double-side image forming time of forming an image on both one face and reverse face of the record sheet 7, as shown in FIG. 2, when the record sheet 7 with the toner image fixed on one side by the fixing unit 12 is conveyed to the discharge roll 17 through the discharge conveying path 16 and is discharged onto the discharge tray 18 by the discharge roll 17, if the trailing end of the record sheet 7 in the conveying direction thereof passes through the switch gate 15, the switch gate 15 is restored to the first position of closing the discharge conveying path 16 by the own weight of the switch gate 15 and opening the double-side conveying path for guiding the record sheet 7 for double-side image forming.

Then, the rotation direction of the discharge roll 17 is switched so that the conveying direction of the record sheet 7 becomes the opposite direction at the timing just after the trailing end of the record sheet 7 in the conveying direction thereof passes through the switch gate 15, and the record sheet 7 is conveyed to the double-side conveying path 20 through the double-side conveying path 19 formed above the switch gate 15 by the conveying force of the discharge roll 17. The record sheet 7 conveyed to the double-side conveying path 20 is conveyed along the double-side conveying path 20 by a conveying roll 21 provided in the double-side conveying path and is again conveyed to the registration roll 11 in a state in which the one face and the reverse face are inverted.

The record sheet 7 is conveyed to the transfer position where the photoconductive drum 2 and the transfer roll 6 abut each other in a synchronized state with the toner image on the photoconductive drum 2 by the registration roll 11 so that the side where no image is formed is positioned on the side of the photoconductive drum 2.

In FIG. 2, numeral 22 denotes a cleaning device for cleaning the surface of the photoconductive drum 2, numeral 23 denotes a control circuit of the image forming apparatus, and numeral 24 denotes a power supply circuit.

Figure 3:
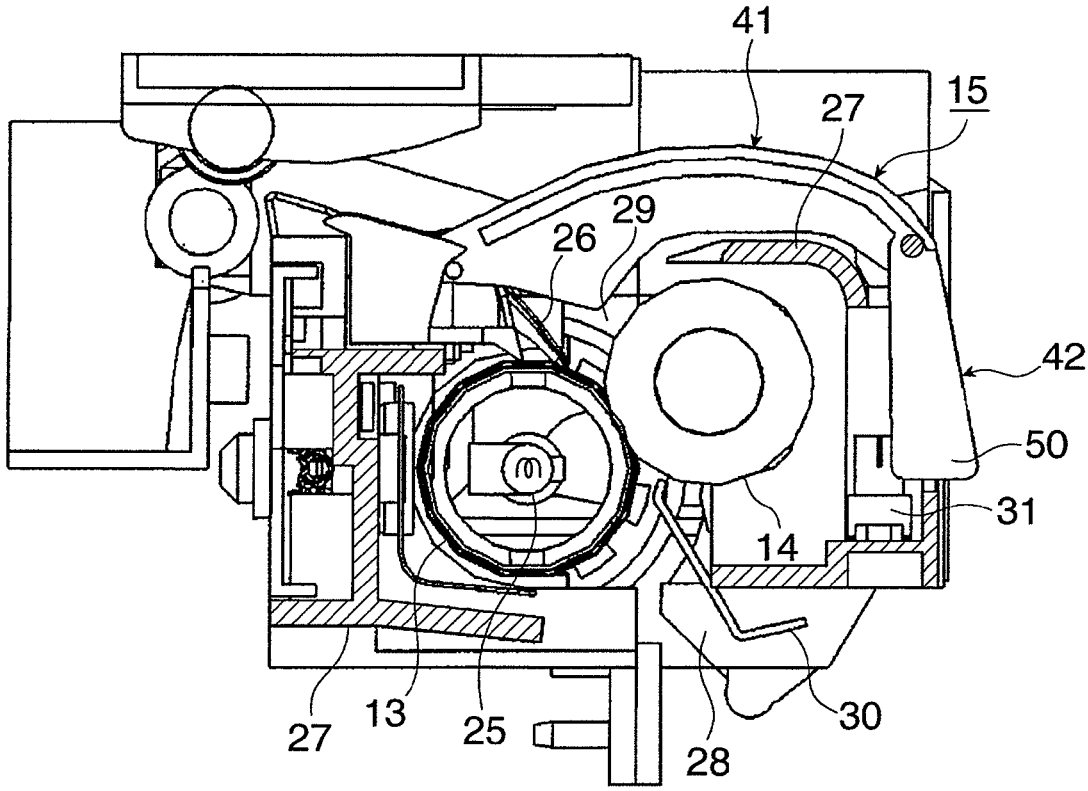
FIG. 3 is a cross-sectional configuration drawing to show a fixing unit.

The fixing unit 12 includes the heating roller 13 containing a heating source 25 and the pressing roller 14 brought into press-contact with the heating roller 13, as shown in FIG. 3. A peeling claw 26 is disposed on the discharge part side of the heating roller 13. Further, a housing 27 of the fixing unit 12 is formed as a box roughly shaped like a rectangular parallelepiped covering the outer peripheries of the heating roller 13 and the pressing roller 14. An introduction part 28 for introducing the record sheet 7 is provided on the entry side of a nip part where the heating roller 13 and the pressing roller 14 come in press-contact with each other, and a discharge part 29 for discharging the record sheet 7 is provided on the exit side of the nip part. A guide chute 30 for guiding the record sheet 7 is also disposed on the entry side of the nip part.

Figure 1:
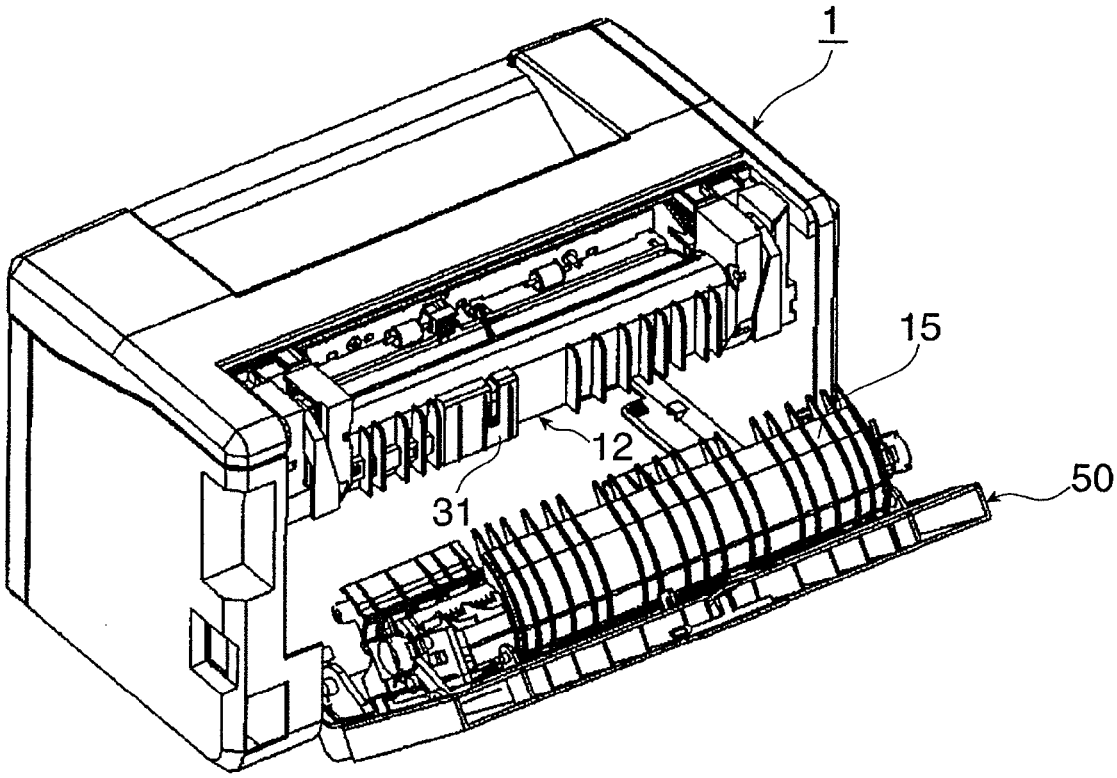
FIG. 1 is an external perspective view to show a monochrome image forming apparatus as an image forming apparatus incorporating a conveying path switch unit according to an Exemplary embodiment 1 of the invention.
Figure 4:
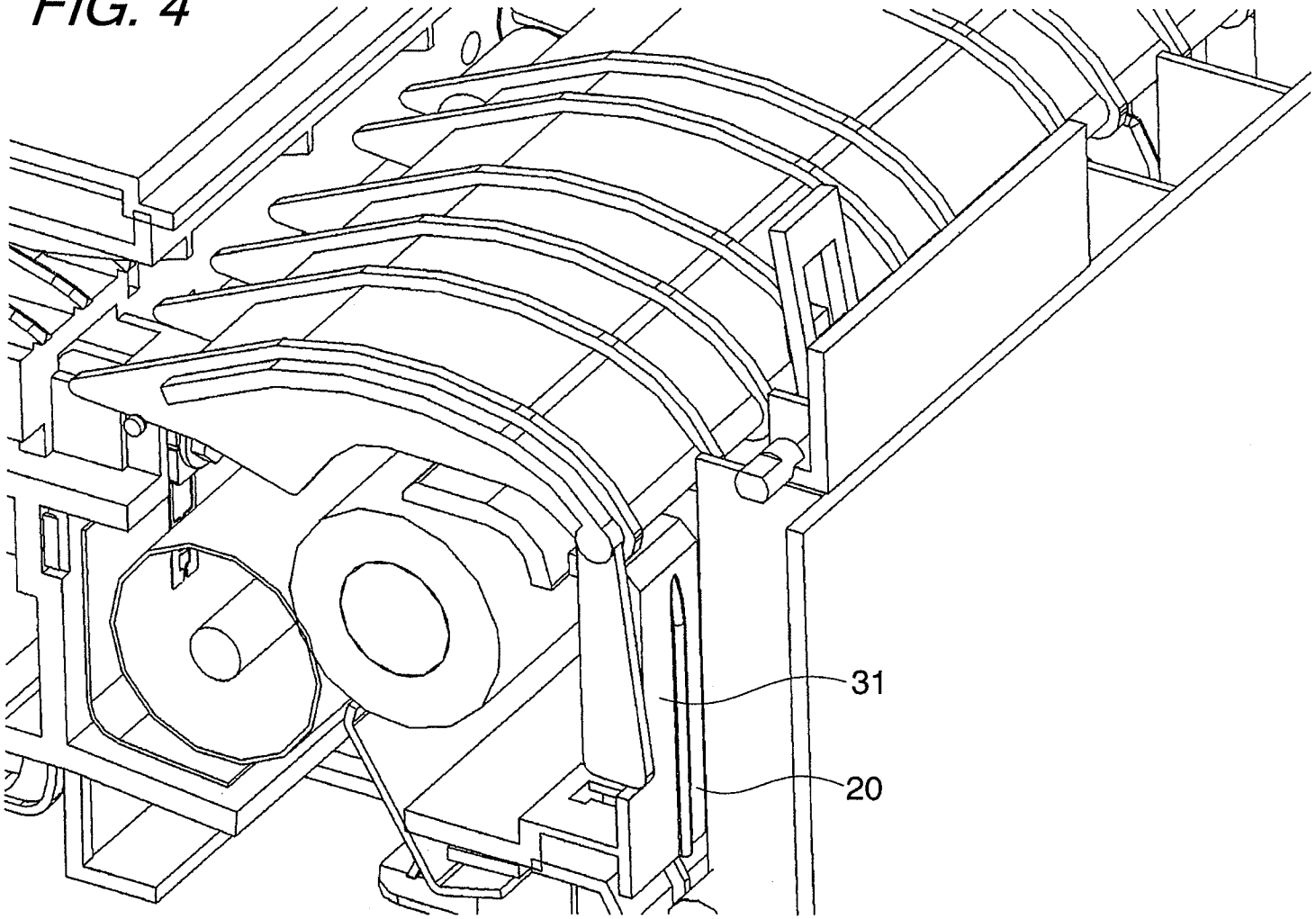
FIG. 4 is a perspective configuration drawing to show the main part of the monochrome image forming apparatus as the image forming apparatus incorporating the conveying path switch unit according to Exemplary embodiment 1.

A sensor 31 as detection means for detecting the rotation position (second position) of the switch gate 15 is disposed on the side face of the housing 27 of the fixing unit 12 on the double-side conveying path 20 side, as shown in FIGS. 1, 3, and 4. The sensor 31 is implemented as a photo interrupter, for example, and usually can receive light emitted from a light emitting element (not shown) at a light receiving element (not shown). An actuator (not shown) of the switch gate 15 rotates and shades light emitted from the light emitting element, whereby the sensor detects that the record sheet 7 passes through the switch gate 15 and the switch gate 15 rotates to the second position.

By the way, in the exemplary embodiment, as shown in FIG. 1, a cover unit 50 for covering the whole face of one side of the image forming apparatus main body 1 and a part of the upper end face of the image forming apparatus main body 1 is provided on the one side face of the image forming apparatus main body 1 (in the figure, the right side face) so that the cover can be opened and closed. That is, the cover is movable between an open state and a close state. As shown in FIG. 2, the cover unit 50 is formed roughly like L-shape in cross section made up of a side face part 55 for covering all of the one side face of the image forming apparatus main body 1 and an upper end part 56 for covering the part above the fixing unit 12 on the upper end face of the image forming apparatus main body 1, and can rotate clockwise in the figure on a supporting point 57 provided at the lower end of the side face part 55.

The switch gate 15 provided at a position corresponding to the discharge part of the fixing unit 12 in the close state is attached to the cover unit 50 for rotation as shown in FIG. 1.

Figure 5:
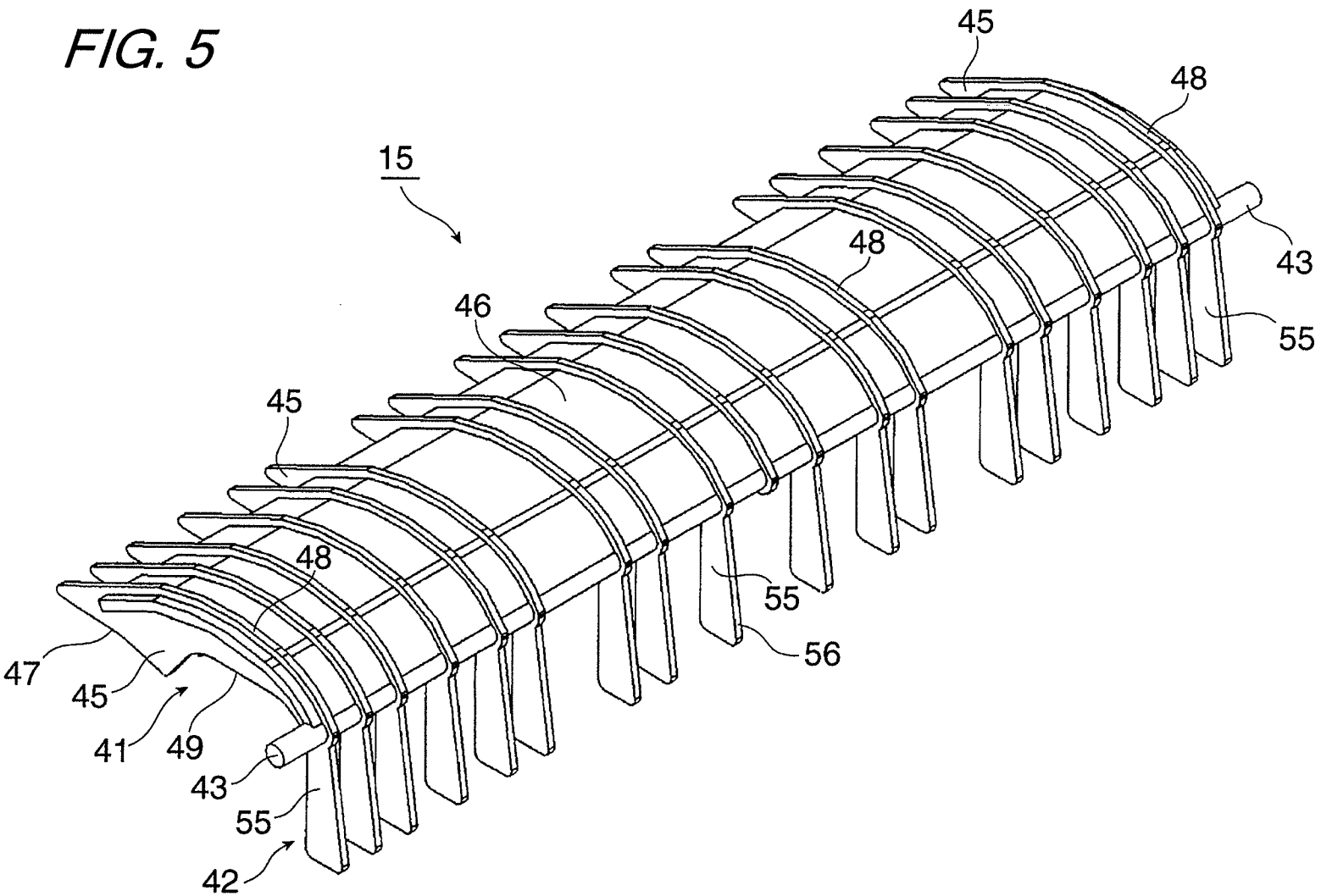
FIG. 5 is a perspective configuration drawing to show the main part of the monochrome image forming apparatus as the image forming apparatus incorporating the conveying path switch unit according to Exemplary embodiment 1.
Figure 6:
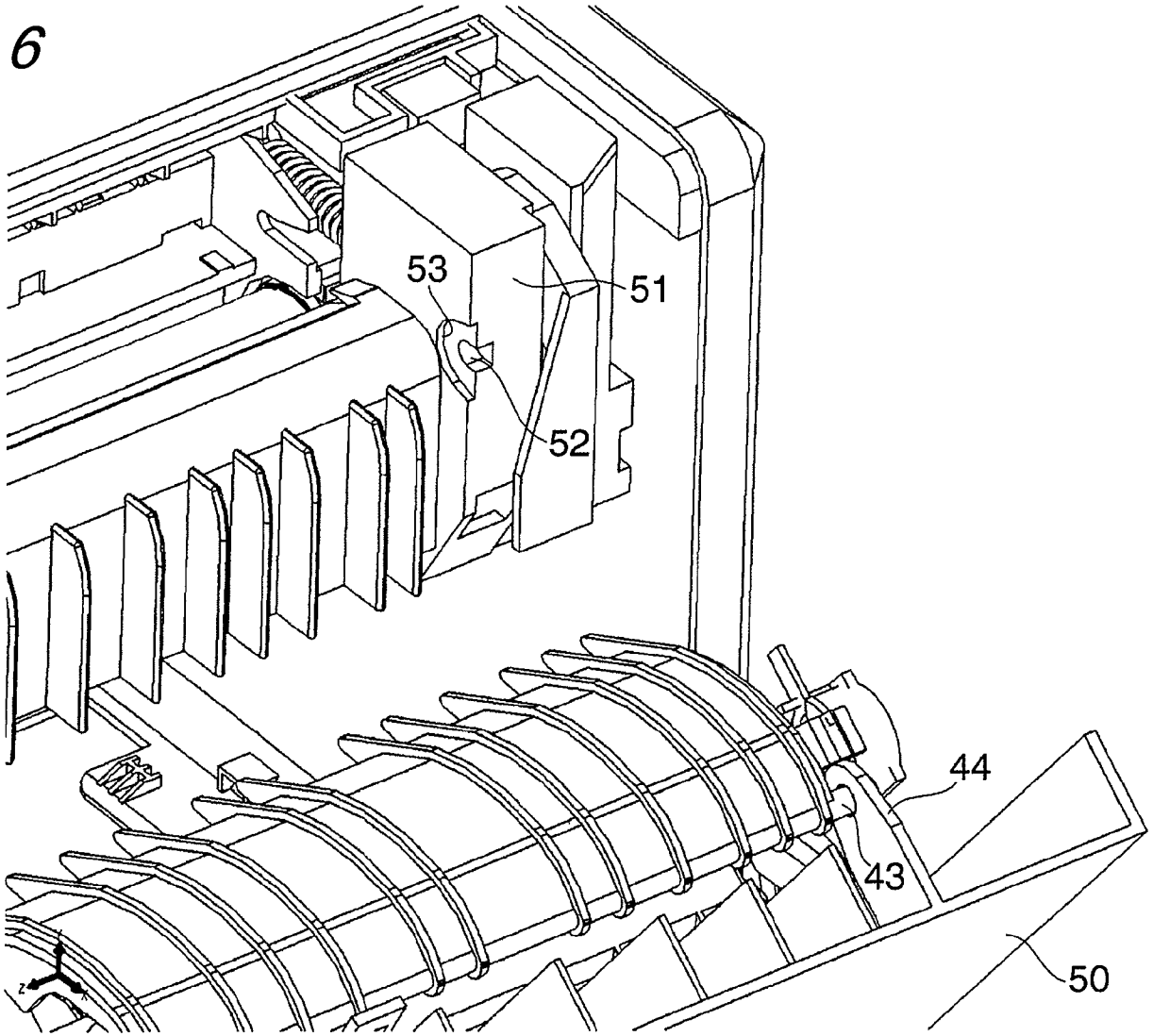
FIG. 6 is a perspective configuration drawing to show the main part of the monochrome image forming apparatus as the image forming apparatus incorporating the conveying path switch unit according to Exemplary embodiment 1.

The switch gate 15 is integrally formed of a molded article of synthetic resin, etc., roughly like L-shape in side faces made up of a switch part 41 for switching the discharge conveying path 16 and the double-side conveying path 19 and an operating arm part 42 provided so as to cross one end part of the switch part 41, as shown in FIG. 5. The switch gate 15 is attached to a shaft support part 44 provided in the proximity of the upper end part of the inner face of the cover unit 50 for rotation through the support shaft 43 provided in the cross part where the switch part 41 and the operating arm part 42 cross each other, as shown in FIG. 6. The shaft support part 44 is provided on the cover unit 50 so as to correspond to both end parts of the support shaft 43. The support shaft 43 is projected from the switch gate in an axial direction of the support shaft 43.

Figure 7:
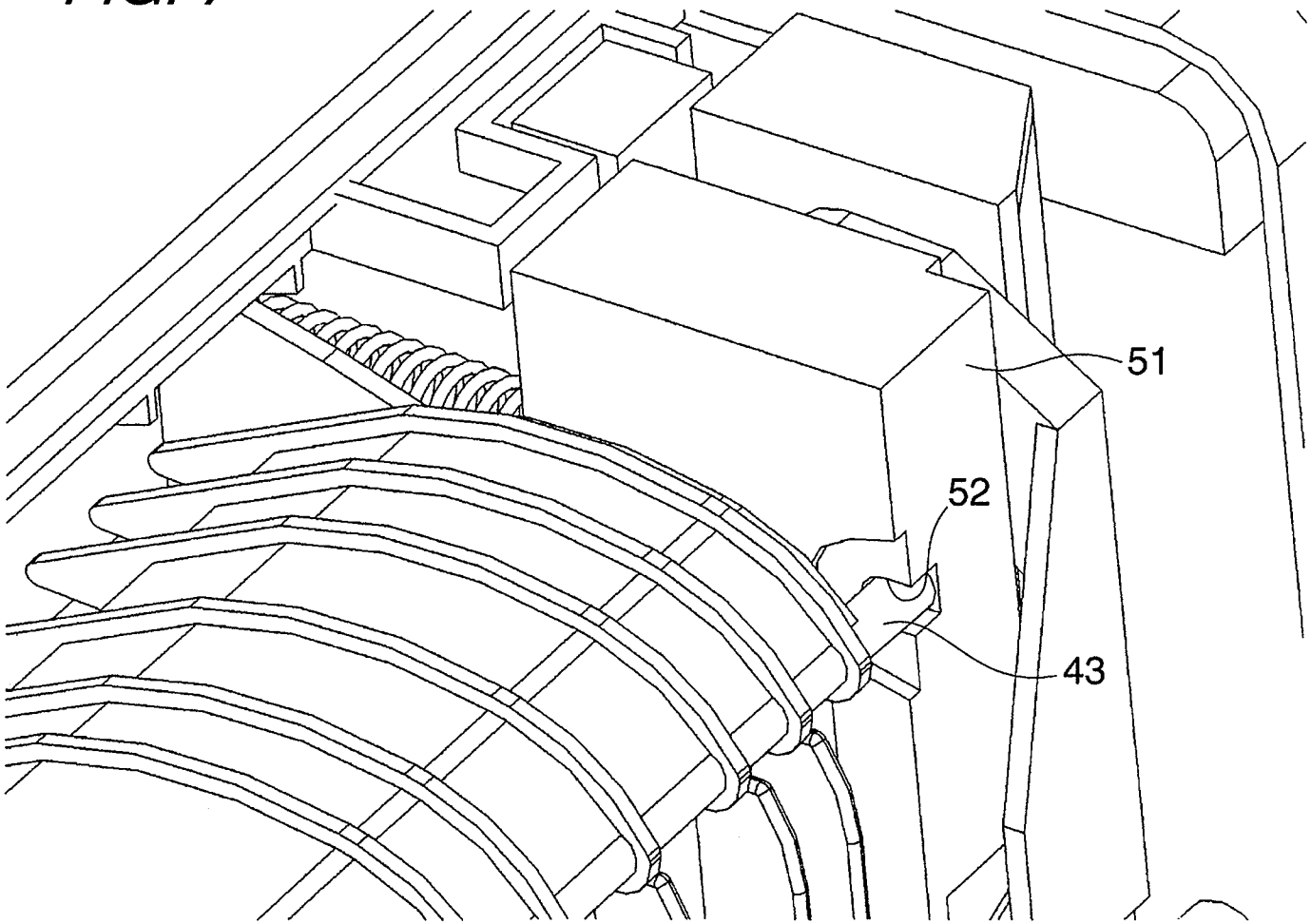
FIG. 7 is a perspective configuration drawing to show the main part of the monochrome image forming apparatus as the image forming apparatus incorporating the conveying path switch unit according to Exemplary embodiment 1.

In the image forming apparatus main body 1, a positioning concave part 52 into which the tip of the support shaft 43 of the switch gate 15 is fitted for positioning and a housing part 53 where the support shaft 43 is housed when the cover unit 50 is closed are provided in both end parts 51 in the length direction of the fixing unit 12, as shown in FIGS. 6 and 7.

In the exemplary embodiment, the switch gate 15 is attached to the cover unit 50 side rather than the image forming apparatus main body 1 side; the cover unit 50 is attached to the image forming apparatus main body 1 so that it can be opened and closed with the supporting point 57 as the center, as shown in FIG. 2.

Thus, an error of the attachment position of the switch gate 15 to the image forming apparatus main body 1 becomes superposition of an attachment error of the cover unit 50 to the image forming apparatus main body 1 and an attachment error of the switch gate 15 to the cover unit 50 and it is feared that the switch gate 15 may be unable to be attached to a predetermined position of the image forming apparatus main body 1 with good accuracy.

Then, in the exemplary embodiment, the positioning concave part 52 into which the tip of the support shaft 43 of the switch gate 15 is fitted for positioning and the housing part 53 where the shaft support part 43 is housed when the cover unit 50 is closed are provided in both end parts 51 in the length direction of the fixing unit 12 and the support shaft 43 of the switch gate 15 is positioned directly in the positioning concave part 52 on the image forming apparatus main body 1 side, as shown in FIGS. 6 and 7, so that the accuracy of the attachment position of the same degree as the case where the switch gate 15 is provided directly in the image forming apparatus main body 1 is secured.

As shown in FIG. 7, a plate spring, etc., made of synthetic resin, etc., for urging the support shaft 43 against the positioning concave part 52 may be provided so that the support shaft 43 of the switch gate 15 reliably abuts the positioning concave part 52 and is positioned and to such an extent that it does not become resistance when the support shaft 43 rotates.

The switch part 41 of the switch gate 15 is formed as a plurality of switch plates 45 each formed like a flat plate are integrally joined with a predetermined spacing by a joint plate 46 formed like a bend shape on side faces, as shown in FIG. 5. The switch plates 45 are placed in a state in which they rise along the up and down direction, and are aimed at the conveying direction of the record sheet 7; only the edge parts positioned at the upper ends of the switch plates 45 come in contact with the record sheet 7, so that contact resistance with the record sheet 7 is decreased. The switch plates 45 are formed as the same shape and include each a discharge guide part 47 provided on the lower face on the tip side in the record sheet discharging direction, a double-side guide part 48 shaped like a curved surface crossing the tip part of the discharge guide part 47 so as to form an acute angle and forming the whole of the upper edge part of the switch plate 45, and an opening guide part 49 crossing the downward projecting lower end part of the discharge guide part 47 so as to form an acute angle for guiding the switch gate 15 when the cover unit 50 is opened.

On the other hand, the operating arm part 42 of the switch gate 15 is made of flat plates 55 provided corresponding to the same positions as the switch plates 45 except the center part and placed crossing the switch plates 45 so as to form a predetermined angle, as shown in FIG. 5. The operating arm part 42 is formed like a shape projecting as side faces 56 of the operating arm part 42 on the double-side conveying path 20 side go downward, and the side faces 56 of the operating arm part 42 become actuator for operating the sensor 31 as shown in FIG. 1.

The switch part 41 and the operating arm part 42 of the switch gate 15 are formed as the same shape so as to prevent skew or curled selvage called dog-ear from occurring on the record sheet 7 as contact resistance with the record sheet 7 varies along the direction crossing the conveying direction of the record sheet 7 according to the width of the record sheet 7 and are placed in bilateral symmetry with the center part as the reference along the direction crossing the conveying direction of the record sheet 7. Of the operating arm part 42, the flat plate 55 for operating the sensor 31 is only the flat plate 55 positioned on one side of the center part, for example.

Figure 8:
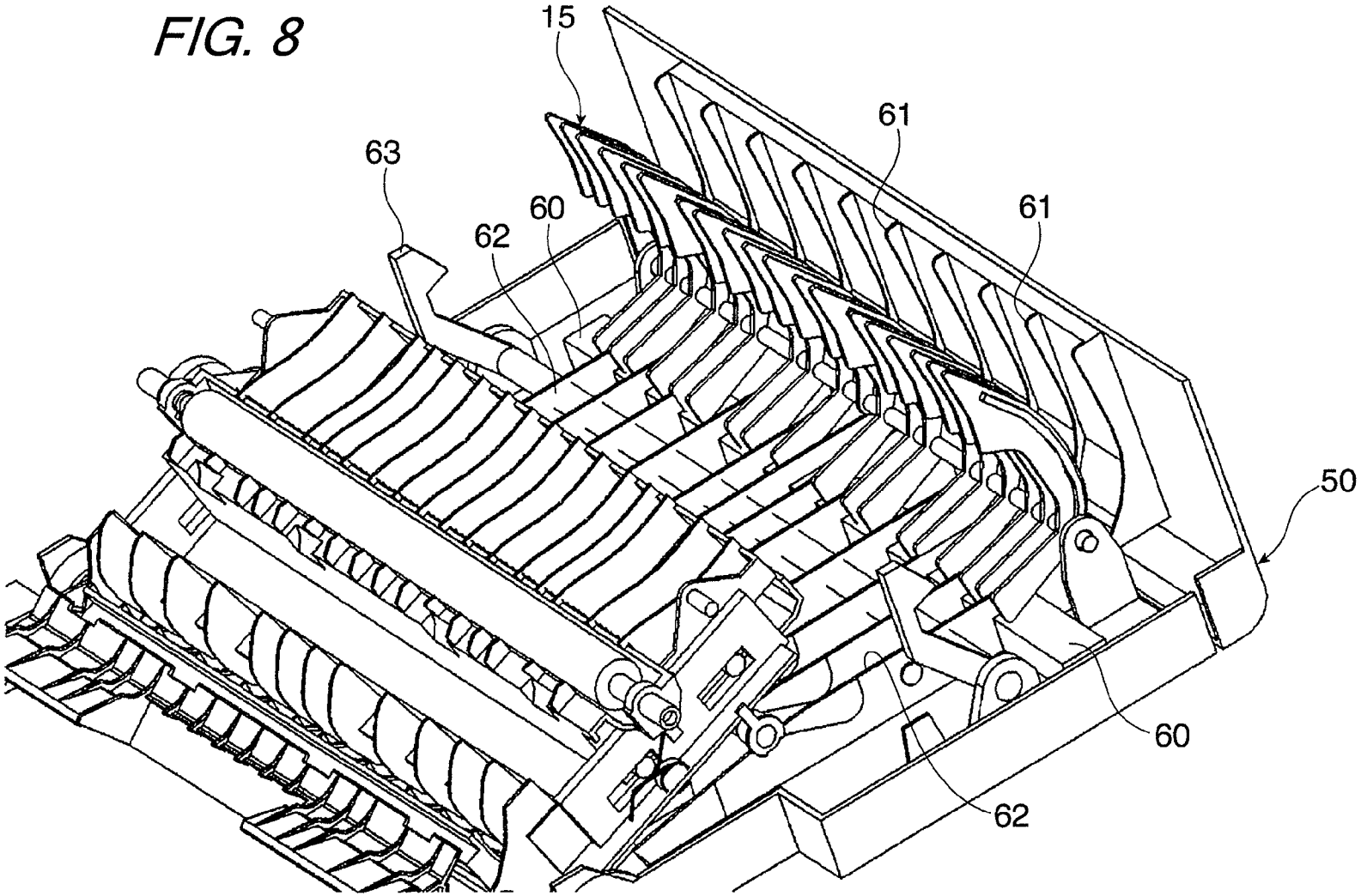
FIG. 8 is a perspective configuration drawing to show the main part of the monochrome image forming apparatus as the image forming apparatus incorporating the conveying path switch unit according to Exemplary embodiment 1.

In the exemplary embodiment, as shown in FIG. 8, a restriction member 60 for restricting rotation of the cover unit 50 is provided so as to prevent hindering of the operation closing the cover unit 50 and prevent damage to the gate member 15 and a member on the image forming apparatus main body 1 side as the gate member 15 attached to the cover unit 50 unnecessarily rotates when the cover unit 50 is opened and the gate member 15 interferes with the member on the image forming apparatus main body 1 side when the cover unit 50 is closed.

As shown in FIG. 8, the restriction member 60 is made of a projection part integrally projecting like a rectangular parallelepiped on the inner face of the cover unit 50 and restricts rotating of the gate member 15 counterclockwise in FIG. 8 as the lower end part of the operating arm part 42 of the gate member 15 abuts. The restriction member 60 may be formed of a separate member from the cover unit 50, of course.

In FIG. 8, numeral 61 denotes a rib for forming a part of the double-side conveying path 19, numeral 62 denotes a rib for forming a part of the double-side conveying path 20, and numeral 63 denotes a fixing lever for fixing the cover unit 50 to the image forming apparatus main body 1 side.

Further, the exemplary embodiment is configured so as to prevent the gate member 15 attached to the cover unit 50 from interfering with a member on the image forming apparatus main body 1 side when the cover unit 50 is opened or closed.

That is, in the exemplary embodiment, in the operation state with the cover unit 50 closed, the gate member 15 needs to be disposed for rotation at a predetermined position in the discharge part of the fixing unit 12 in the image forming apparatus main body 1, as shown in FIG. 3. The gate member 15 is configured so as to switch the discharge conveying path 16 and the double-side conveying path 19 only by the upward force of the record sheet as described above and if the attachment position of the gate member 15 and the operation characteristic of operation resistance, etc., vary a predetermined value or more, immediately a paper jam of the record sheet or the like is caused to occur.

Figure 9:
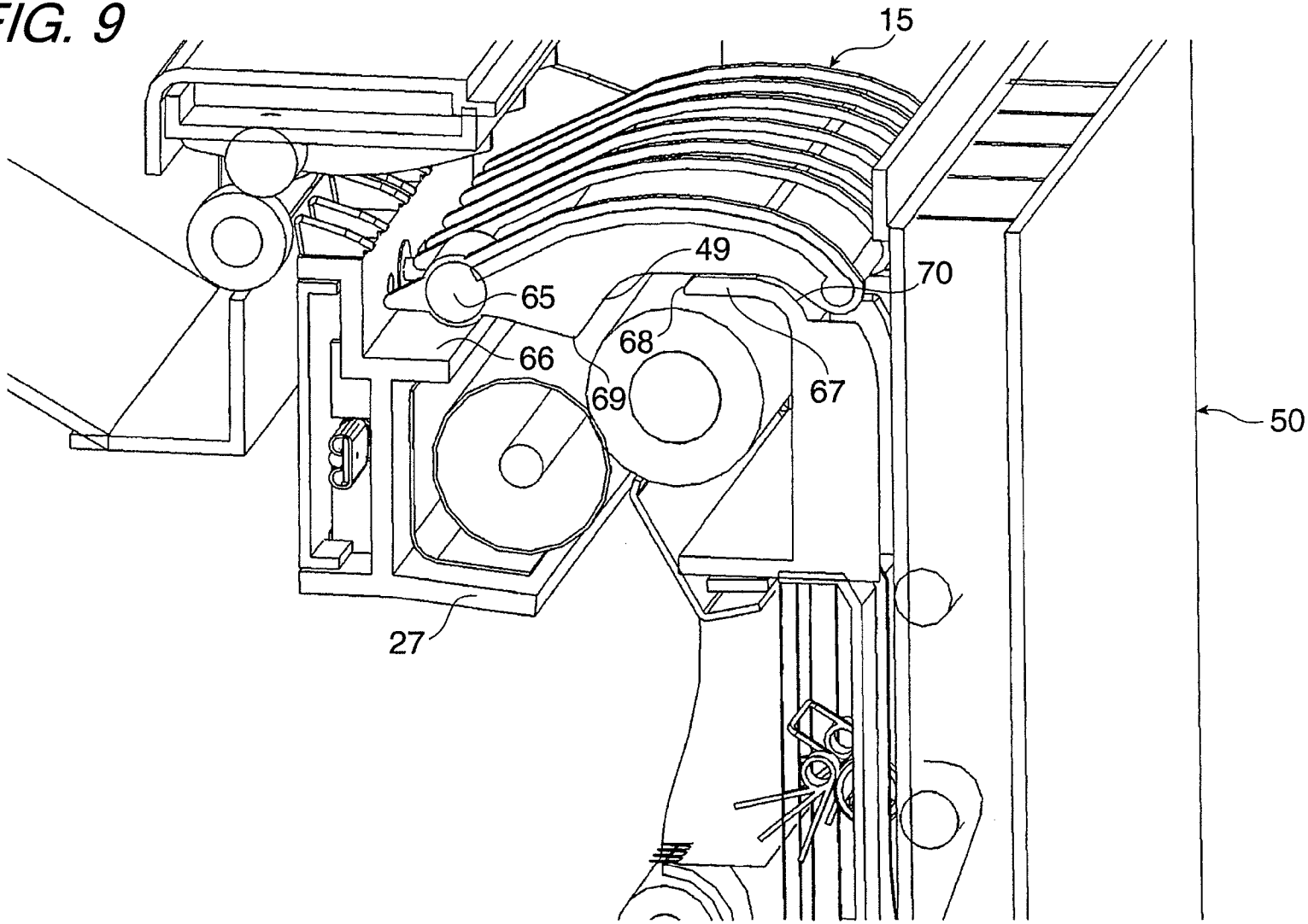
FIG. 9 is a perspective configuration drawing to show the main part of the monochrome image forming apparatus as the image forming apparatus incorporating the conveying path switch unit according to Exemplary embodiment 1.

Then, in the exemplary embodiment, as shown in FIG. 9, a positioning part 65 is provided at the tip of the gate member 15 so that the gate member 15 is positioned at a predetermined position in the discharge part of the fixing unit 12 when the cover unit 50 is closed, and the lower end part of the positioning part 65 abuts a predetermined reference plane 66 of the housing 27 of the fixing unit 12, whereby the gate member 15 is positioned.

When the cover unit 50 is opened, as shown in FIG. 9, as described above, the opening guide part 49 provided in the switch gate 15 abuts a curved face 68 provided on the inner end face of a housing 67 provided above the pressing roller 14 in the housing 27 of the fixing unit 12 and is rotated clockwise and a lower end edge part 69 of the switch gate 15 moves along the curved face 68 and the upper end face of the housing 67, whereby the cover unit 50 is opened without interference of the switch gate 15 with any other member on the image forming apparatus main body 1 side.

Further, when the cover unit 50 is closed, the switch gate 15 is restricted at the position shown in FIG. 8 and if the cover unit 50 is closed to the image forming apparatus main body 1 side in this state, as described above, the discharge guide part 47 provided on the lower face of the tip of the switch gate 15 abuts a curved face 70 provided on the outer end face of the housing 67 provided above the pressing roller 14 in the housing 27 of the fixing unit 12 and is rotated clockwise and the lower end edge part 69 of the switch gate 15 moves along the curved face 70 and the upper end face of the housing 67, whereby the cover unit 50 is closed without interference of the switch gate 15 with any other member on the image forming apparatus main body 1 side.

In the exemplary embodiment, the opening guide part 49 of the switch gate 15 and the discharge guide part 47 of the switch gate 15 guide the switch gate 15 when the cover unit 50 is opened or closed, but a separate guide member for guiding the switch gate 15 may be provided in the shaft support part, etc., of the switch gate 15 or the shape of some of the switch parts 41 of the switch gate 15 may be made different from the shape of any other switch part for use only for guiding the switch gate 15.

However, if a separate guide member for guiding the switch gate 15 is provided in the shaft support part, etc., of the switch gate 15, the number of components increases and the configuration becomes complicated; if the shape of some of the switch parts 41 of the switch gate 15 is made different from the shape of any other switch part for use only for guiding the switch gate 15, it is feared that the switch part 41 used only for guiding may interfere with the record sheet 7. Thus, it is desirable that the apparatus should be configured as described above.

In the configuration described above, in the image forming apparatus according to the exemplary embodiment, if a conveying failure of a record medium occurs in the discharge part of the fixing means, the record medium where the conveying failure occurs can be removed easily as follows.

In the image forming apparatus, as shown in FIG. 2, a toner image is formed on the photoconductive drum 2 in response to image information and the toner image formed on the photoconductive drum 2 is transferred onto the record sheet 7 by the transfer roll 6 and then the record sheet 7 to which the toner image is transferred is heated and pressed by the fixing unit 12 to fix the toner image. The record sheet 7 with the toner image fixed thereon passes through the discharge conveying path 16 through the switch gate 15 and is conveyed to the discharge roll 17 and at the single-side image forming time, is discharged by the discharge roll 17 onto the discharge tray 18 provided in the upper part of the image forming apparatus main body 1.

Figure 10:
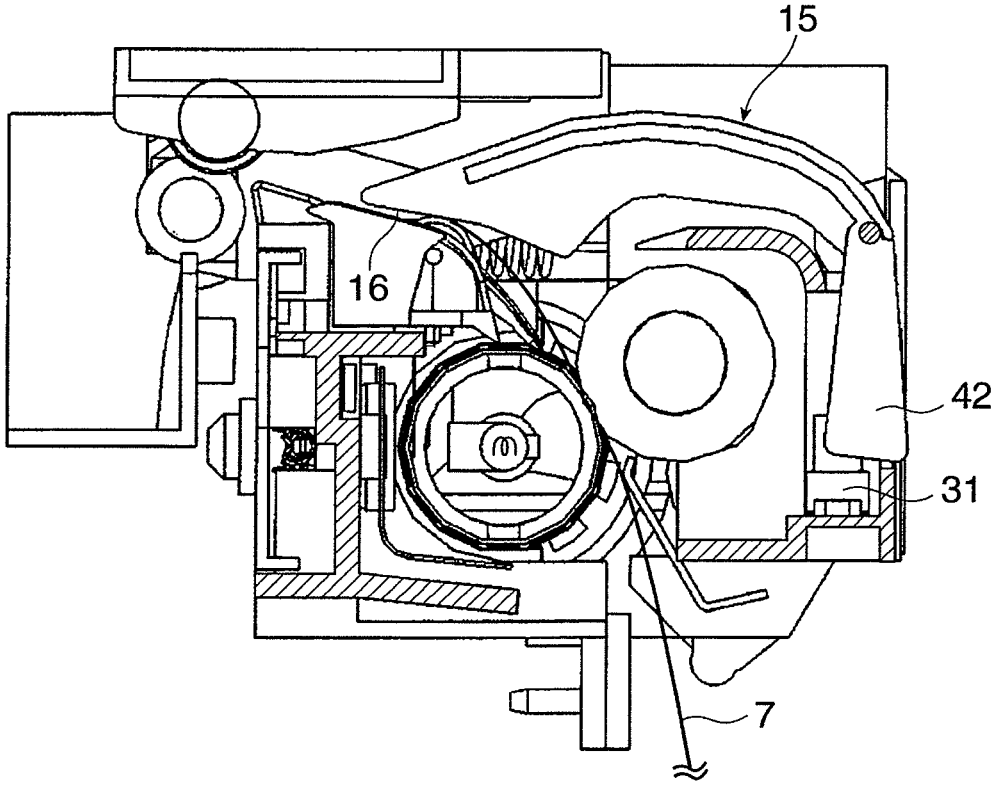
FIG. 10 is a cross-sectional configuration drawing to show the operation of the conveying path switch unit.
Figure 11:
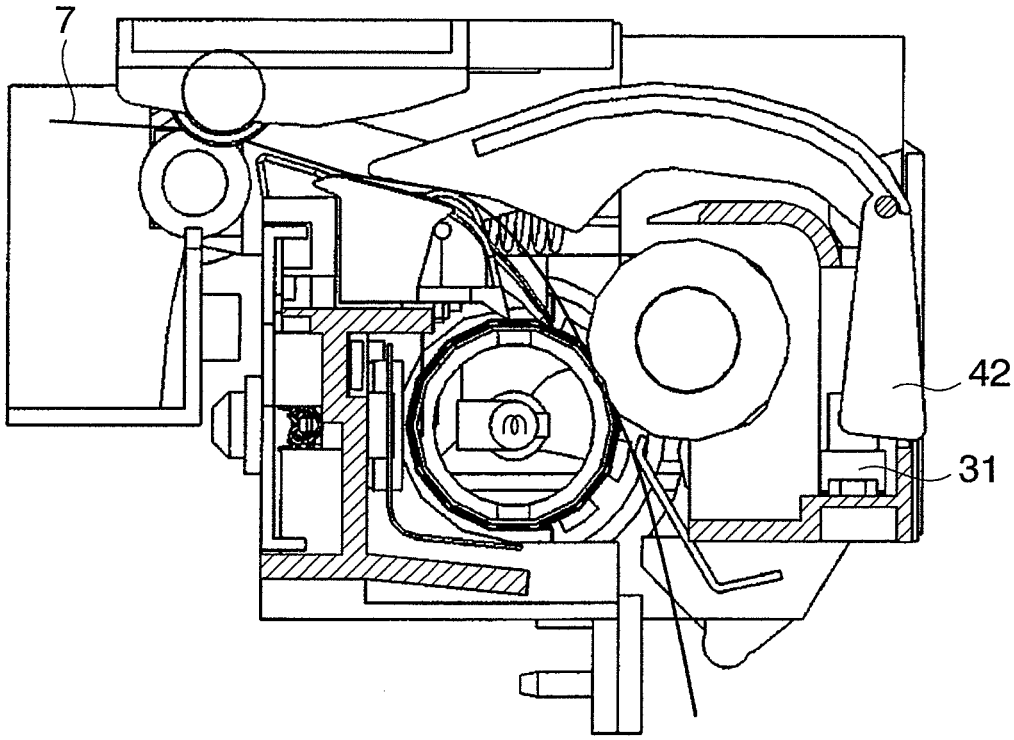
FIG. 11 is a cross-sectional configuration drawing to show the operation of the conveying path switch unit.

At the time, as shown in FIGS. 10 and 11, the switch gate 15 is pushed up by the tip of the record sheet 7 discharged from the fixing unit 12 and rotates to the second position in the clockwise direction in the figure and the sensor 31 is shaded by the operating arm part 42 of the switch gate 15 and detects that the leading end of the record sheet 7 arrives at the position of the switch gate 15 and upon completion of passage of the record sheet 7 through the switch gate 15, the switch gate 15 closes the discharge conveying path 16 and is restored to the first position as shown in FIG. 3.

Thus, if a paper jam of the record sheet 7 occurs ahead of the switch gate 15 in the discharge part of the fixing unit 12, the switch gate 15 is not rotated clockwise in the figure and the sensor 31 does not detect the record sheet 7 passing through and the control circuit 23 detects occurrence of the jam.

If a jam occurs ahead of the discharge roll 17 after the record sheet 7 passes through the switch gate 15, the switch gate 15 remains rotated clockwise in the figure and when the estimated passage time of the record sheet 7 through the switch gate 15 has elapsed, the sensor 31 does not detect the record sheet 7 passing through and occurrence of the jam is detected.

Figure 12:
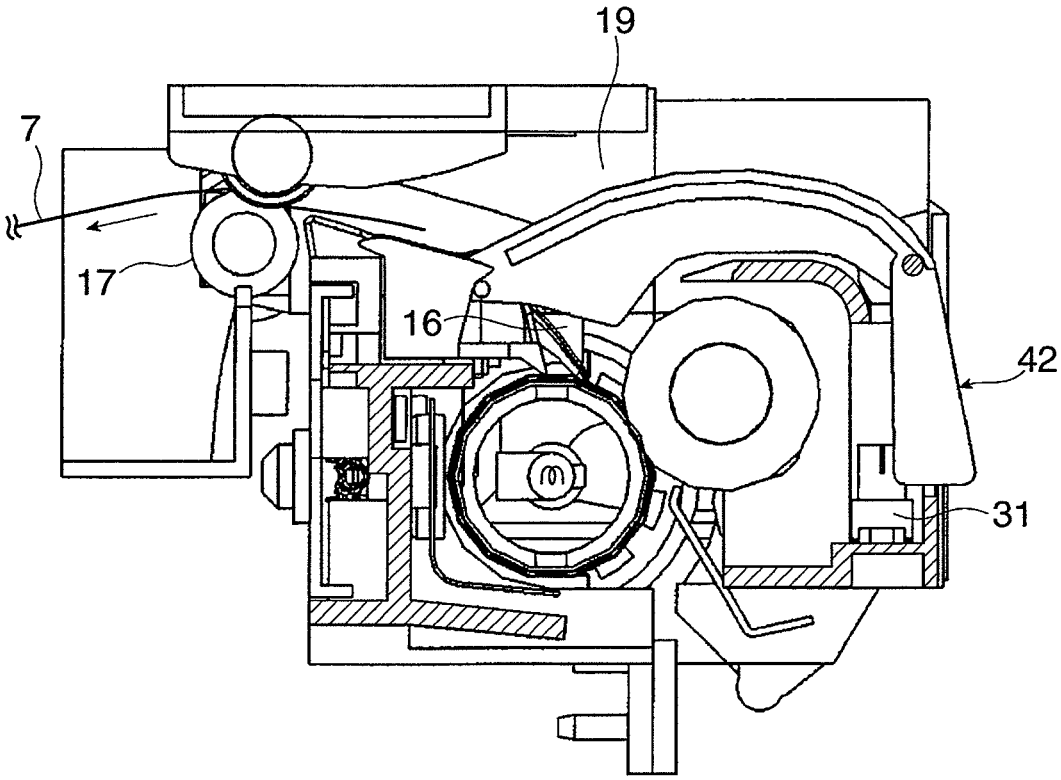
FIG. 12 is a cross-sectional configuration drawing to show the operation of the conveying path switch unit.
Figure 13:
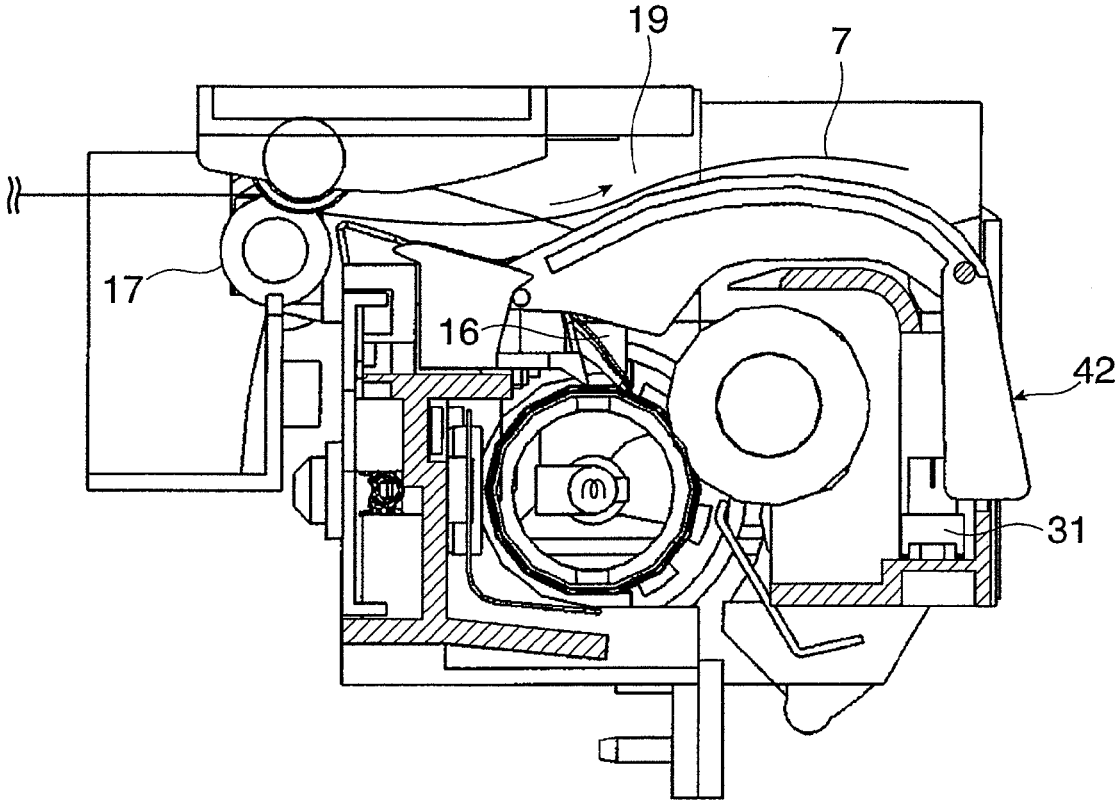
FIG. 13 is a cross-sectional configuration drawing to show the operation of the conveying path switch unit.

To form an image on both sides of the record sheet 7, when the record sheet 7 with an image fixed on one side by the fixing unit 12 is discharged by the discharge roll 17, as shown in FIG. 12, if the trailing end of the record sheet 7 passes through the switch gate 15, the switch gate 15 rotates counterclockwise in the figure by the own weight and is restored to the former first position. Then, the sensor 31 detects that the switch gate 15 is restored, and the discharge roll 17 is rotated in the opposite direction based on a detection signal from the sensor 31. As shown in FIG. 13, the record sheet 7 is conveyed by the discharge roll 17 rotated in the opposite direction and is conveyed to the double-side conveying path 20 through the double-side conveying path 19 switched by switching of the switch gate 15.

Figure 14:
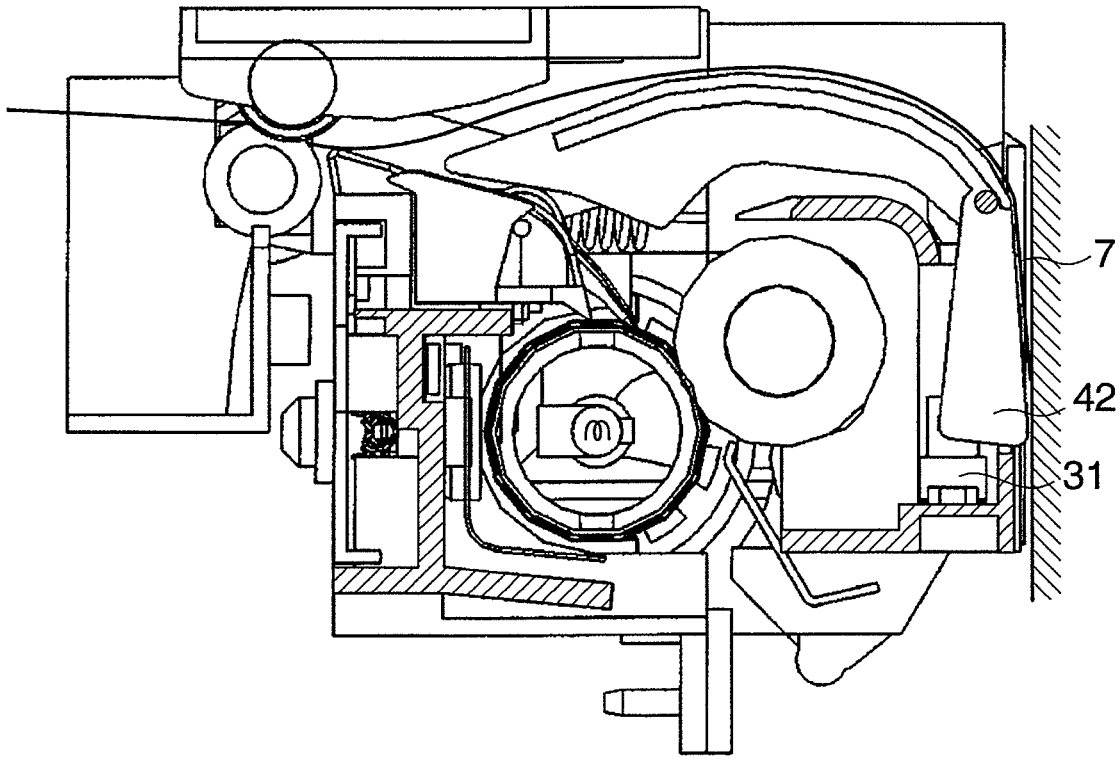
FIG. 14 is a cross-sectional configuration drawing to show the operation of the conveying path switch unit.
Figure 15:
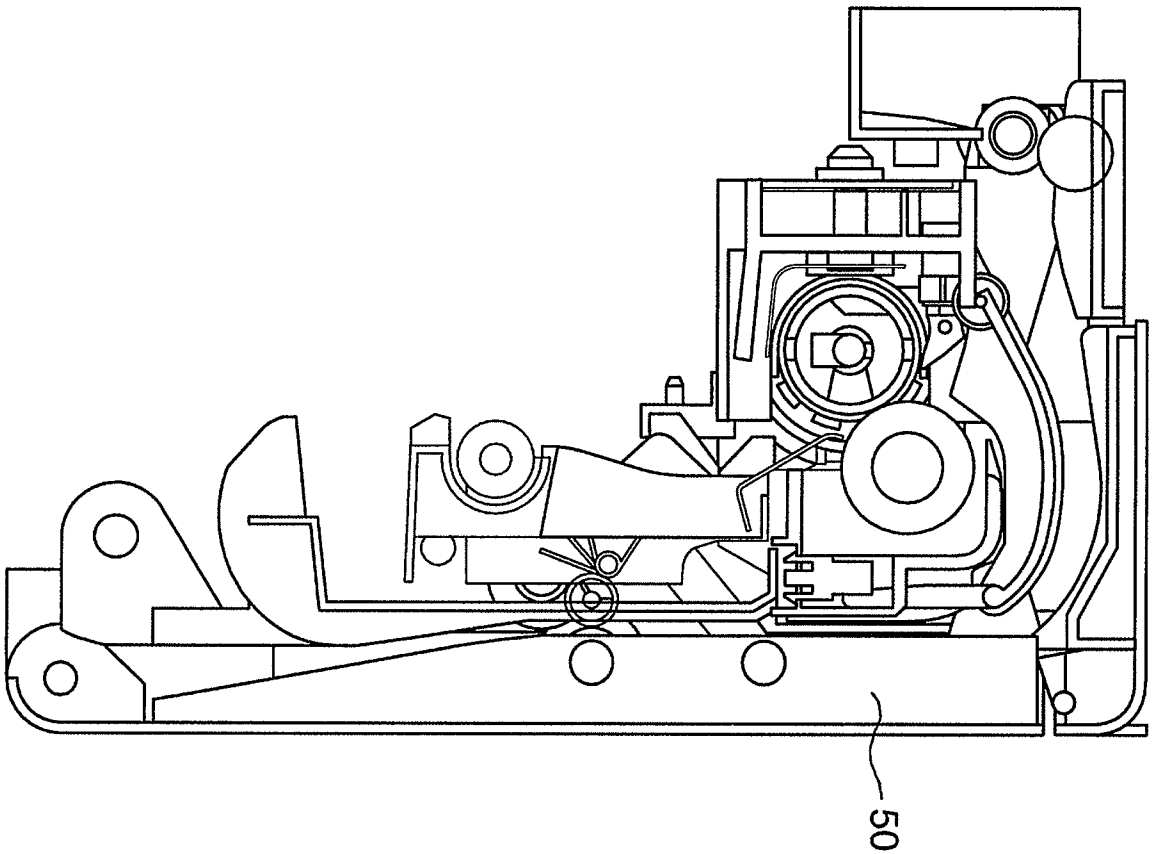
FIG. 15 is a cross-sectional configuration drawing to show the operation of the conveying path switch unit.

At the time, as shown in FIG. 14, the switch gate 15 has the operating arm part 42 pushed by the leading end of the record sheet 7 conveyed to the double-side conveying path 20 and rotates to the second position in the clockwise direction in the figure and the sensor 31 is shaded by the operating arm part 42 of the switch gate 15 and upon completion of passage of the record sheet 7 through the switch gate 15, the switch gate 15 is restored to the first position closing the discharge conveying path 16.

Thus, when the record sheet 7 is conveyed to the double-side conveying path 20 through the double-side conveying path 19, if a paper jam of the record sheet 7 occurs ahead of the double-side conveying path 20, the switch gate 15 is not rotated clockwise and the sensor 31 does not detect the record sheet 7 passing through and occurrence of the jam is detected.

If a jam occurs at a midpoint in the double-side conveying path 20 after the record sheet 7 passes through the double-side conveying path 19, the switch gate 15 remains rotated clockwise and when the estimated passage time of the record sheet 7 through the switch gate 15 has elapsed, the sensor 31 does not detect the record sheet 7 passing through and occurrence of the jam is detected.

Thus, when a jam of the record sheet 7 is detected according to the switch gate 15, a message indicating occurrence of the jam is displayed on a control panel, etc., (not shown) and the user opens the cover unit 50 of the image forming apparatus and removes the record sheet 7 where the jam occurs.

To opens the cover unit 50, the user releases the fixing lever 63 of the cover unit 50 and rotates the cover unit 50 clockwise. Then, as shown in FIG. 16, the opening guide part 49 of the switch gate 15 abuts the curved face of the housing 67 of the fixing unit 12 and is rotated clockwise and the edge part of the switch gate 15 abuts the upper end face of the housing 67 and is guided and interference with the member on the image forming apparatus main body 1 side is avoided.

Figure 16:
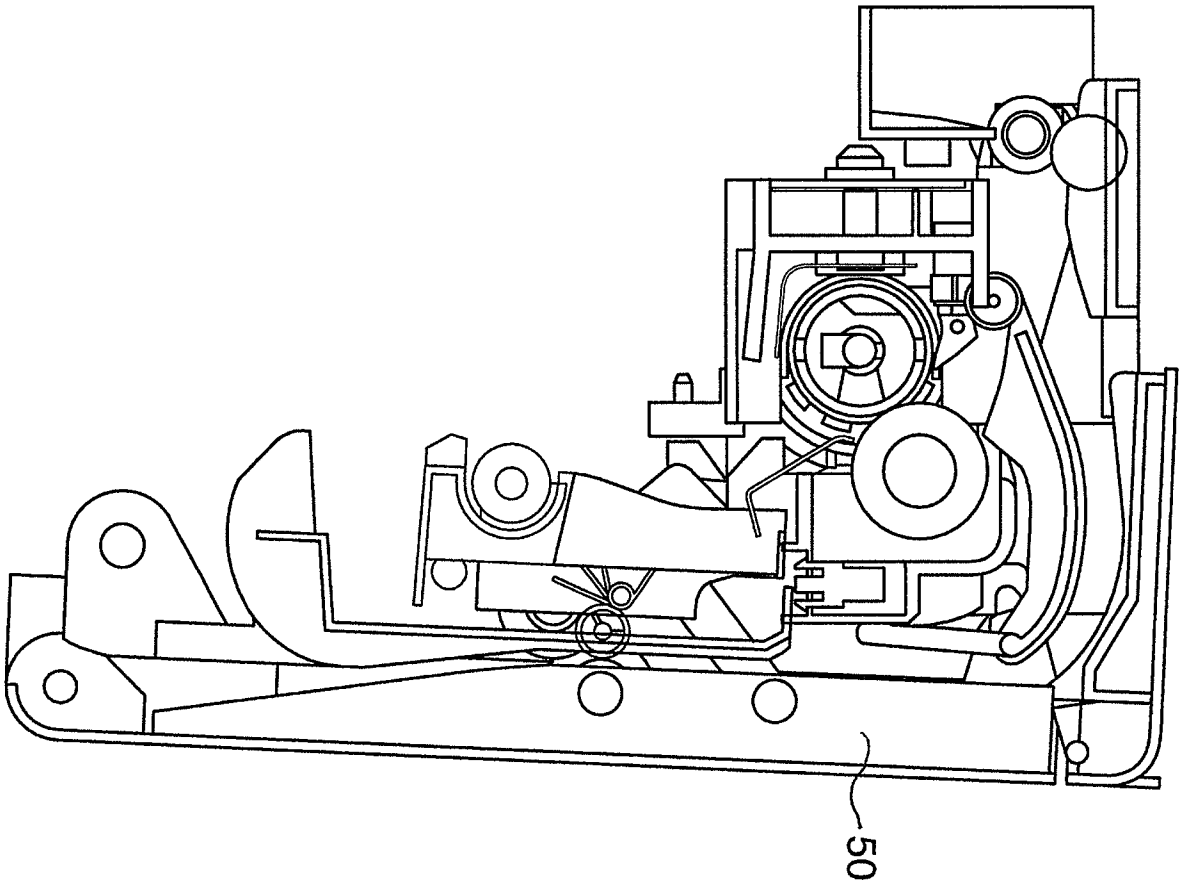
FIG. 16 is a cross-sectional configuration drawing to show the operation of the conveying path switch unit.

When the cover unit 50 is opened to a position shown in FIG. 16, the lower end of the operating arm part 42 of the switch gate 15 abuts the restriction member 60 and with the attitude held, the cover unit 50 is opened completely.

Figure 17:
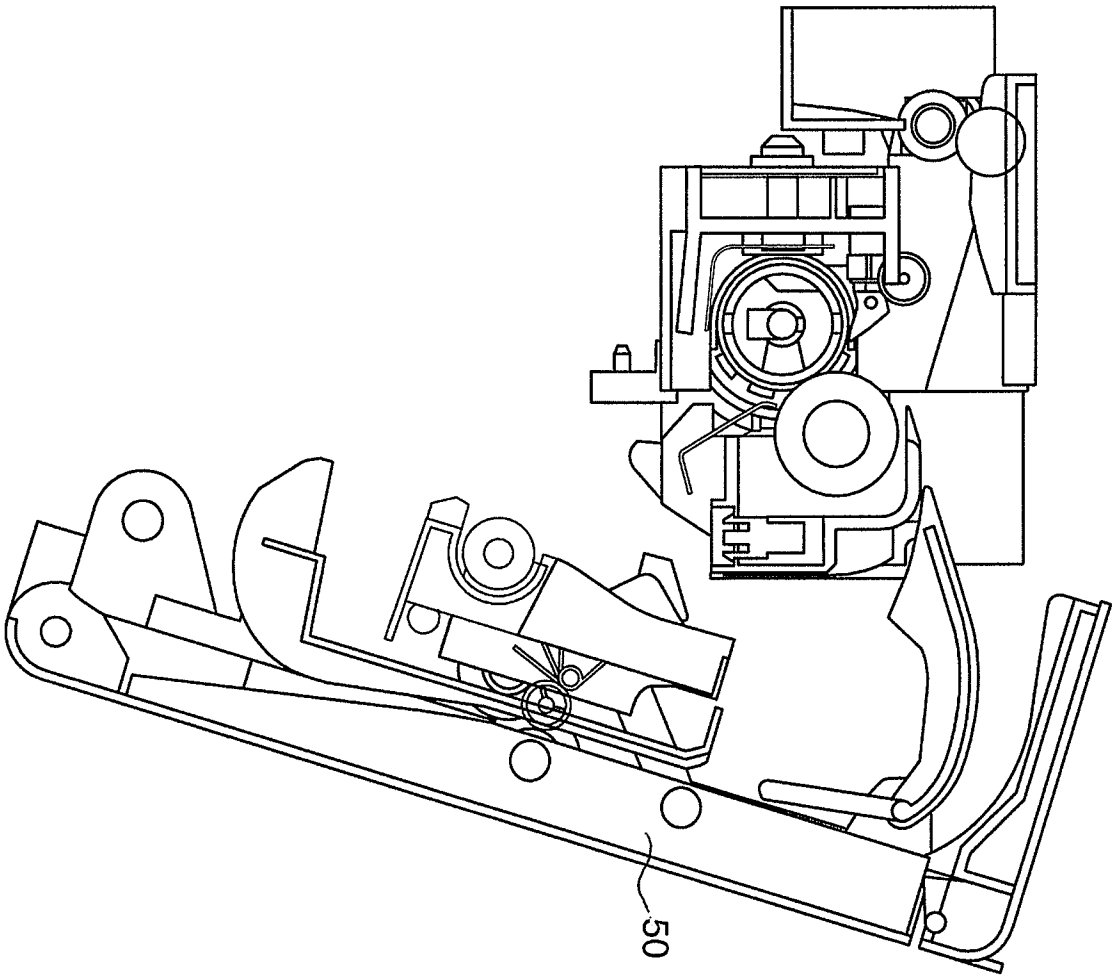
FIG. 17 is a cross-sectional configuration drawing to show the operation of the conveying path switch unit.

Thus, the user is enabled to easily remove the record sheet 7 jammed in the discharge part of the fixing unit 12, the double-side conveying path 19, 20, etc., as shown in FIG. 17.

Figure 18:
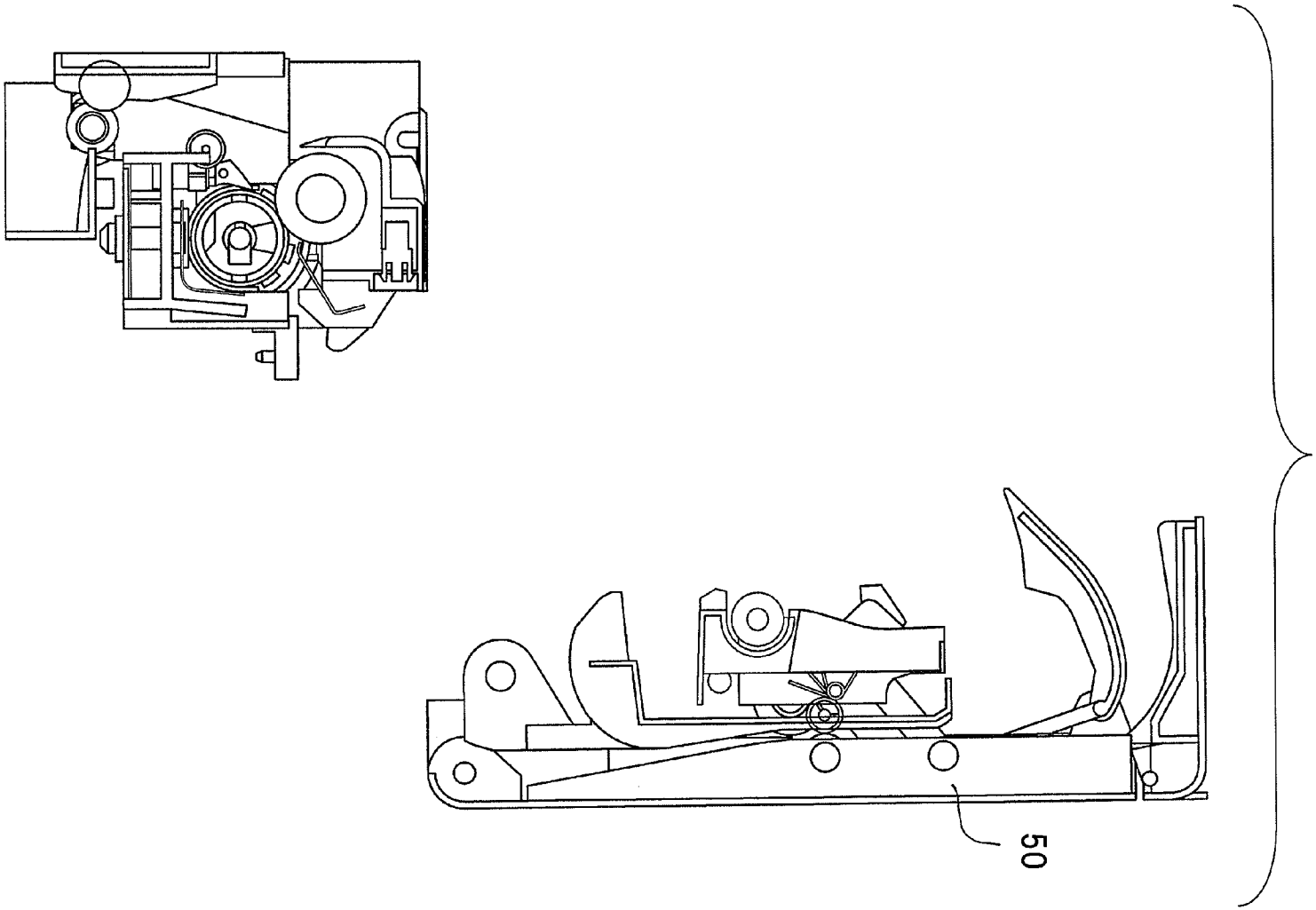
FIG. 18 is a cross-sectional configuration drawing to show the operation of the conveying path switch unit.
Figure 19:
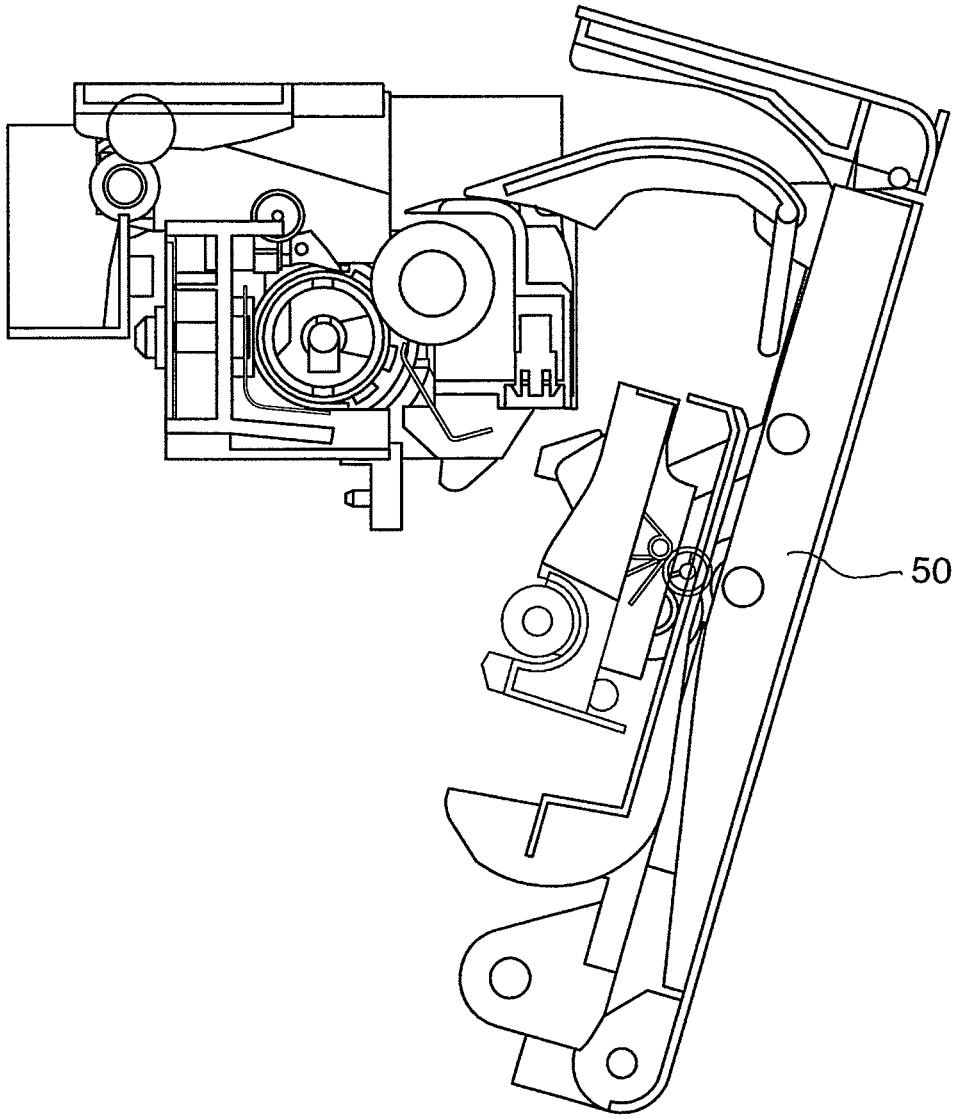
FIG. 19 is a cross-sectional configuration drawing to show the operation of the conveying path switch unit.
Figure 20:
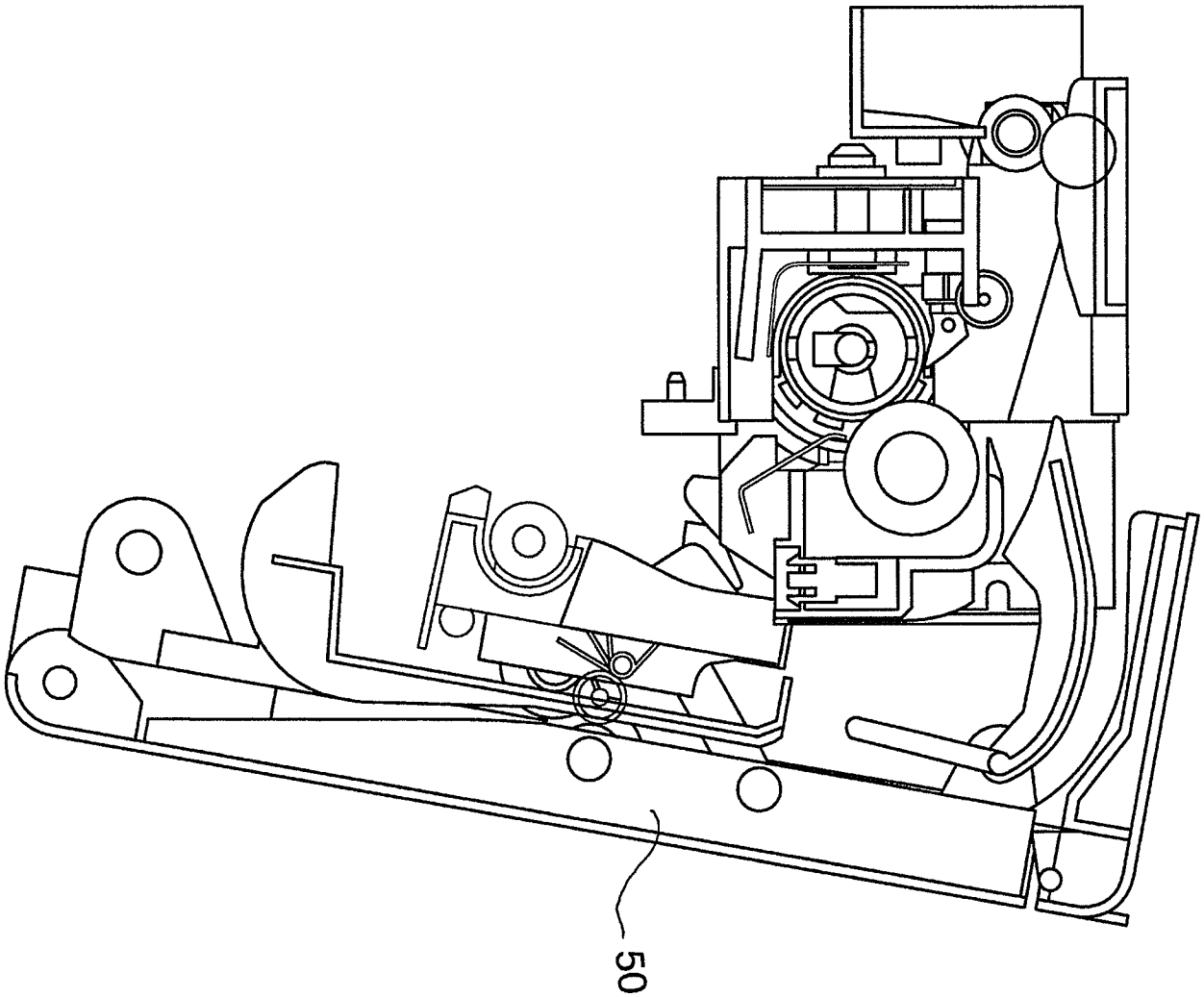
FIG. 20 is a cross-sectional configuration drawing to show the operation of the conveying path switch unit.
Figure 21:
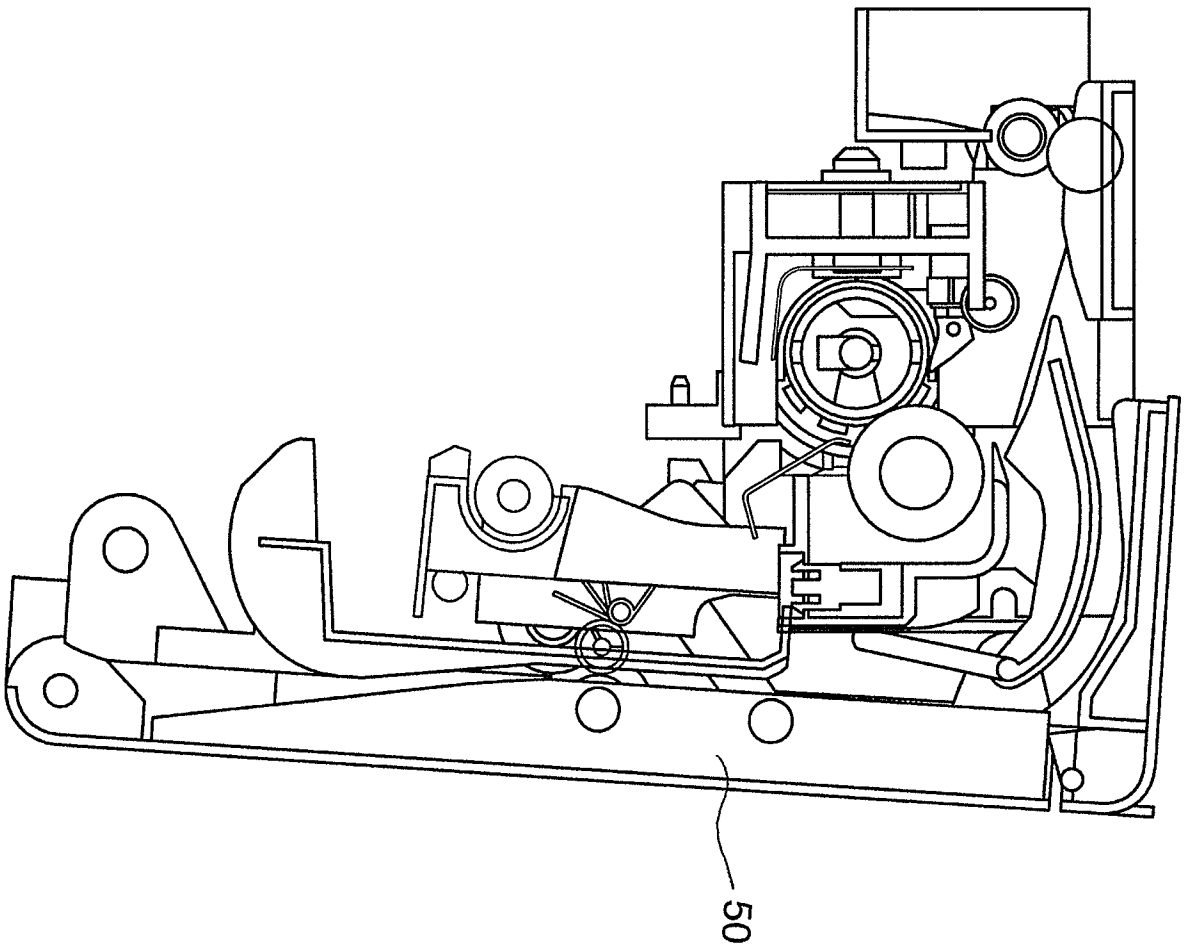
FIG. 21 is a cross-sectional configuration drawing to show the operation of the conveying path switch unit.

When the user closes the cover unit 50 from the completely open state reversing the opening operation described above, the discharge guide part 47 of the switch gate 15 abuts the curved face 70 of the housing 67 of the fixing unit 12 as shown in FIG. 18, the switch gate 15 is rotated clockwise, the edge part of the switch gate 15 abuts the upper end face of the housing 67 and moves, and the cover unit 50 is closed completely as shown in FIG. 14.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The exemplary embodiments were chosen and described in order to best explain the principles of the invention and its practical application, thereby enabling other skilled in the art to understand the invention for various exemplary embodiments and with the various modifications as are suited to the particular use contemplated. It is intended that the scope of the invention be defined by the following claims and their equivalents.

What is claimed is:

1. A conveying path switching structure comprising:

a cover unit that is attached to an image forming apparatus main body so as to be movable between a closed state and an open state in which a fixing unit is exposed; and a conveying path switch unit that is rotatably attached to the cover unit and that switches a conveying path of a record medium between a discharge conveying path and a double-side conveying path in the closed state, wherein the discharge conveying path is a path where the record medium is conveyed from a discharge part of the fixing unit to a discharge unit that discharges the record medium to outside of the image forming apparatus main body in the closed state, and the double-side conveying path is a path where the record medium is conveyed again to an image forming unit of the image forming apparatus main body from the discharge unit in a state where the record medium is inverted, wherein the cover unit includes a restriction member that restricts rotation of the conveying path switch unit in the open state, the conveying path switch unit is attached to the cover unit through a shaft member, the shaft member is positioned in a positioning part of the image forming apparatus main body in the closed state, the cover unit includes a shaft support part which supports the shaft member, and the positioning part is a positioning concave part into which a tip of the shaft member is fitted when the cover unit is in the closed state for positioning the conveying path switch unit.

2. The conveying path switching structure according to claim 1, wherein the restriction member is formed integrally with the cover unit.

3. The conveying path switching structure according to claim 1, wherein the conveying path switch unit is guided by an outer cabinet of the fixing unit while a part of the conveying path switch unit abuts on the outer cabinet when the cover unit is moved between the open state and the closed state.

4. The conveying path switching structure according to claim 1 further comprising a detection unit that detects rotation of the conveying path switch unit, wherein the conveying path switch unit is rotated by the conveyance of the record medium through the discharge conveying path and the double-side conveying path.

5. The conveying path switching structure according to claim 1, further comprising a housing part that is capable of housing the shaft support part.

6. An image forming apparatus comprising:

an image forming apparatus main body;

an image forming unit that is provided in the image forming apparatus main body and that forms a toner image on a record medium;

a fixing unit that fixes the toner image on the record medium;

a discharge unit that discharges the record medium to outside of the image forming apparatus main body;

a cover unit that is attached to the image forming apparatus main body so as to be movable between a closed state and an open state in which the fixing unit is exposed; and a conveying path switch unit that is rotatably attached to the cover unit and that switches a conveying path of the record medium between a discharge conveying path and a double-side conveying path in the closed state, wherein the discharge conveying path is a path where the record medium is conveyed from a discharge part of the fixing unit to the discharge unit in the closed state, the double-side conveying path is a path where the record medium is conveyed again to the image forming unit from the discharge unit in a state where the record medium is inverted, and the conveying path switch unit is disposed at a position corresponding to the discharge part of the fixing unit, wherein the cover unit includes a restriction member that restricts rotation of the conveying path switch unit in the open state, the conveying path switch unit is attached to the cover unit through a shaft member, the shaft member is positioned in a positioning part of the image forming apparatus main body in the closed state, the cover unit includes a shaft support part which supports the shaft member, and the positioning part is a positioning concave part into which a tip of the shaft member is fitted when the cover unit is in the closed state for positioning the conveying path switch unit.

7. The image forming apparatus according to claim 6, wherein the restriction member is formed integrally with the cover unit.

8. The image forming apparatus according to claim 6, wherein the conveying path switch unit is guided by an outer cabinet of the fixing unit while a part of the conveying path switch unit abuts on the outer cabinet when the cover unit is moved between the open state and the closed state.

9. The image forming apparatus according to claim 6 further comprising a detection unit that detects rotation of the conveying path switch unit, wherein the conveying path switch unit is rotated by the conveyance of the record medium through the discharge conveying path and the double-side conveying path.

* * * * *